US010588202B1

(12) United States Patent
Harrison

(10) Patent No.: US 10,588,202 B1
(45) Date of Patent: Mar. 10, 2020

(54) COMMUNICATIVE LIGHTING SYSTEMS

(71) Applicant: John Harrison, Wichita, KS (US)

(72) Inventor: John Harrison, Wichita, KS (US)

(73) Assignee: TECHNOLOGY FOR HUMANKIND LLC, Wichita, KS (US)

( * ) Notice: Subject to any disclaimer, the term of this patent is extended or adjusted under 35 U.S.C. 154(b) by 0 days.

(21) Appl. No.: 15/584,313

(22) Filed: May 2, 2017

Related U.S. Application Data

(60) Provisional application No. 62/330,357, filed on May 2, 2016.

(51) Int. Cl.
*H05B 37/02* (2006.01)
*H05B 33/08* (2020.01)

(52) U.S. Cl.
CPC ..... *H05B 37/0272* (2013.01); *H05B 33/0851* (2013.01); *H05B 33/0863* (2013.01)

(58) Field of Classification Search
CPC ..... H05B 37/02; H05B 37/0209; H05B 37/0227; H05B 37/0272; H05B 33/08; H05B 33/0842; H05B 33/0848; H05B 33/0851; H05B 33/0863
See application file for complete search history.

(56) References Cited

U.S. PATENT DOCUMENTS 8,248,467 B1 * 8/2012 Ganick ..... G01C 21/206 348/116
2009/0230894 A1 * 9/2009 De Goederen .... H05B 37/0272 315/314
2009/0243517 A1 * 10/2009 Verfuerth ..... H05B 37/0272 315/315
2012/0026726 A1 * 2/2012 Recker ..... F21S 9/037 362/157
2015/0123569 A1 * 5/2015 Knaapen ..... H05B 33/0803 315/297
2016/0174346 A1 * 6/2016 Koriyama ..... H05B 37/0272 315/130
2016/0286629 A1 * 9/2016 Chen ..... H05B 37/0272
2016/0338179 A1 * 11/2016 Aliakseyeu ..... H05B 37/0245

* cited by examiner

*Primary Examiner* — Jason Crawford
(74) *Attorney, Agent, or Firm* — Kutak Rock LLP

(57) ABSTRACT

A communicative lighting system may comprise a plurality of network connected light sources. Each light source may possess a unique identifier permitting light sources to be associated with one another. An input received by one light source may alter the light output of that light source as well as other light sources associated with the light source. The light output of a light source may be altered by changing color, brightening or dimming, blinking, adjusting which of a plurality of light emitting diodes are activated, or otherwise modifying the type or amount of light output.

17 Claims, 6 Drawing Sheets

COMMUNICATIVE LIGHTING SYSTEMS

CROSS-REFERENCE TO RELATED APPLICATIONS

This application claims the benefit of U.S. provisional patent application No. 62/330,357, entitled "COMMUNICATIVE LIGHTING SYSTEMS," filed on May 2, 2016, and which is incorporated herein by reference.

FIELD OF INVENTION

The present invention relates to lighting. More particularly, the present invention relates to network connected lighting systems.

BACKGROUND AND DESCRIPTION OF THE RELATED ART

Light has been used for both illumination and communication for time immemorial. Surely, since shortly after humans harnessed the power of fire sharing light has been a way to express welcome and belonging. Of course, specific intentions can be expressed using light as well. In America, "one if by land, two if by sea," is a famous example of the use of light to communicate information. Light sources such as bonfires, lanterns, and stoplights have long been used to communicate welcome, availability, and other information to those who can view the light provided by those light sources.

SUMMARY OF THE INVENTION

The present invention permits the use of light for communication over distances greater than the distance from which a light source may be directly viewed. Two or more light sources may be associated with one another, such that a first light source may alter the operation of at least the second light source, or vice versa. While a person viewing the second light source may be well out of sight of the first light source, the change in illumination by the second light source in response to the remote first light source may communicate using the emotional power of light across distances not before possible. By associating network connected light sources with one another, the present invention permits one or more individuals to communicate thoughts and emotions over a great distance.

In some examples, the present invention may comprise a communicative lighting system. Such an exemplary system may comprise a first light source connected to a first network, the first light source having at least one input mechanism, at least one light output mechanism, and a permanently assigned first identifier retained in a non-transitory computer-readable memory within the first light source, the non-transitory computer-readable memory within the first light source further providing computer readable instructions to be executed by a computer processor within the first light source. Such an exemplary system may further comprise a second light source connected to a second network, the second light source having at least one input mechanism, at least one light output mechanism, and a permanently assigned second identifier retained in a non-transitory computer-readable memory within the second light source, the non-transitory computer-readable memory within the second light source further providing computer readable instructions to be executed by a computer processor within the second light source. Such an exemplary system may yet further comprise a server connected to at least one network accessible to both the first light source via the first network and the second light source via the second network, the server receiving messages from at least the first light source and the second light source to associate the first light source and the second light source with one another, such that when an input is made using the at least one input mechanism at the first light source the operation of the at least one light output mechanism of the second light source alters and such that when an input is made using the at least one input mechanism at the second light source the operation of the at least one light output mechanism of the first light source alters. In examples, the computer readable instructions retained in the non-transitory computer-readable memories of the first light source and the second light source may cause the computer processors of the first light source and the second light source to contact the server to register a network address of each of the first light source and the second light source, and the receipt of an input at the input mechanism of the first light source may cause a message to be transmitted from the first light source to the server and then from the server to the second light source to alter the operation of the at least one light output mechanism of the second light source, and the receipt of an input at the input mechanism of the second light source may cause a message to be transmitted from the second light source to the server and then from the server to the first light source to alter the operation of the at least one light output mechanism of the first light source. In some examples, the at least one input mechanism of the first light source and the at least one input mechanism of the second light source may comprise a touch-sensitive surface on a shade covering the at least one light output mechanism. In some examples, the touch-sensitive surface may comprise a conductive ink applied to a shade panel, and/or a conducting frame that retains a shade panel, and/or a base section of the light source. In further examples, the at least one light output mechanism of the first light source and the second light source may comprise a plurality of light emitting diodes. In some examples, altering the operation of the plurality of light emitting diodes may comprise changing the color of the light emitted by the plurality of light emitting diodes. In yet further examples, the computer readable instructions retained in the non-transitory computer-readable memories of the first light source and the second light source may further cause the computer processors of the first light source and the second light source to dim the light output from the plurality of light emitting diodes over time if no further inputs are received by the first light source and the second light source. In additional examples, the computer readable instructions retained in the non-transitory computer-readable memories of the first light source and the second light source may cause the first light source and the second light source to be accessible over a data connection by a computing device to configure the operation of the light source. In examples, configuring the operation of the first light source using the computing device to access the light source over the data connection may comprise entering the unique identifier of the second light source to pair the first light source and the second light source in at the server.

In some examples in accordance with the present invention, a communicative lighting system may comprise a plurality of light sources, each of the plurality of light sources comprising a plurality of light emitting diodes contained within a shade, an input mechanism, a wireless network connection providing a data connection to at least one wireless network, at least one computer processor that receives inputs from the input mechanism, controls the output of the light emitting diodes, and sends and receives communications over the wireless network connection, and a non-transitory computer-readable memory containing a permanently assigned unique identifier corresponding to that light source and computer readable instructions retained in a non-transitory form to be executed by a computer processor within the first light source to perform at least part of a method of interaction between at least two of the plurality of light sources. Such an exemplary system in accordance with the present invention may further comprise a server accessible by at least some of the plurality of light sources via at least one network, the server having at least one computer processor operating based upon computer-readable instructions retained in a non-transitory form to cause the server to perform at least part of the method of interaction between at least two of the plurality of light sources. In examples, the method of interaction between at least two of the plurality of light sources may comprise, in response to an input received at an input device of a first light source, altering the output of the plurality of light emitting diodes of the first light source; in response to an input received at an input device of a first light source, transmitting a message to at least a second light source; and at the second light source, in response to the message from the first light source, altering the output of the plurality of light emitting diodes of the second light source. In examples, the method further may further comprise configuring at least a pair of the plurality of light sources using a computing device connected via the wireless network connection of at least one of the pair of the plurality of light sources to enter the unique identifier of at least one other of the plurality of light sources to be associated with the at least one of the pair of light sources at the server. In examples of systems in accordance with the present invention, the input mechanism of at least some of the plurality of light sources may comprise a conductive ink applied to at least a portion of the shade of the light source. In further examples of systems in accordance with the present invention, the input mechanism of at least some of the plurality of light sources may comprise a conductive frame retaining at least a panel of the shade of the light source. In some examples of the present invention, altering the output of the plurality of light emitting diodes may comprise altering the color of light emitted. In yet further examples of systems in accordance with the present invention, the method of interaction between at least two of the plurality of light sources may further comprise transmitting messages between light sources via the server. In yet further examples of systems in accordance with the present invention, the method of interaction between at least two of the plurality of light sources may further comprise dimming the light emitted from the light emitting diodes of the light source as a function of time if the light source does not receive an input from the input device or a message from another light source.

BRIEF DESCRIPTION OF THE SEVERAL VIEWS OF THE DRAWINGS

Examples of systems and methods in accordance with the present invention are described in conjunction with the attached drawings, wherein.

DETAILED DESCRIPTION

Figure 1:
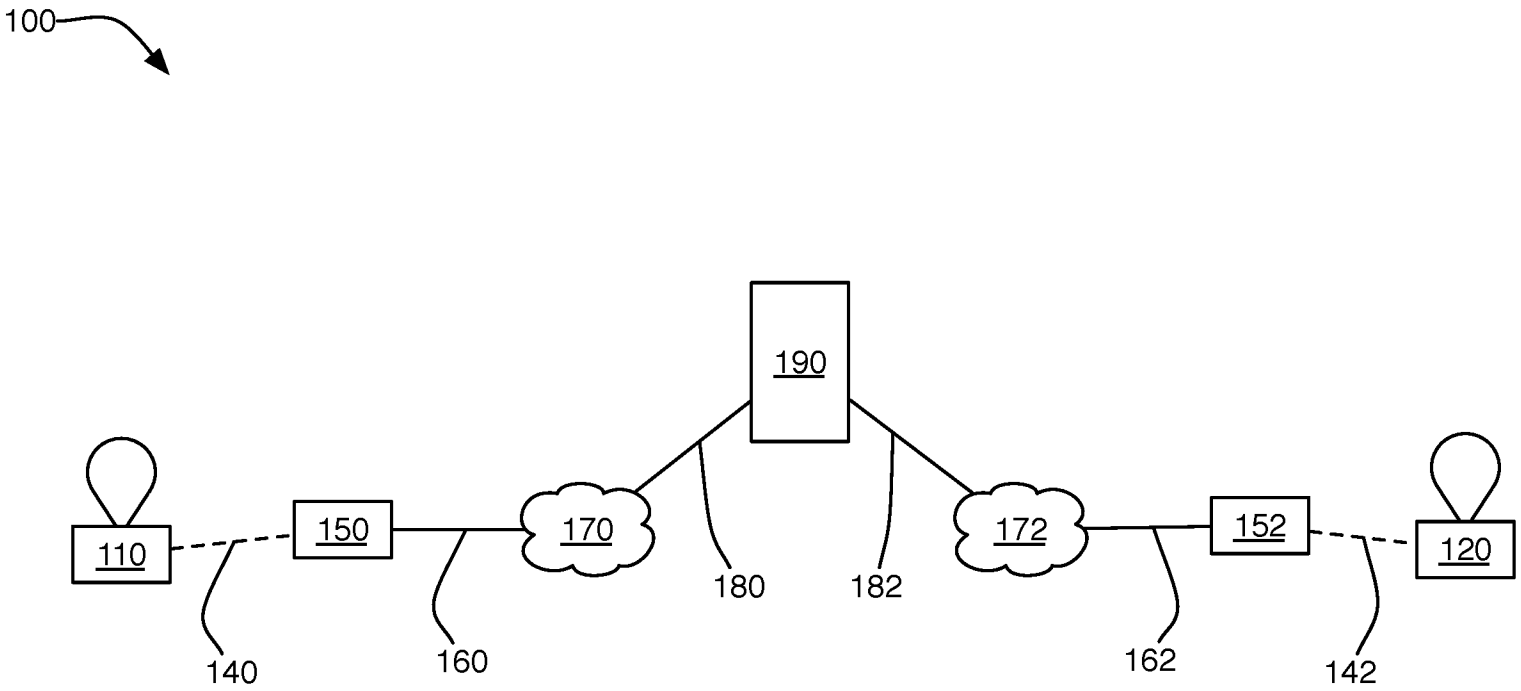
FIG. 1 schematically illustrates an example of a pair of networked lights in accordance with the present invention.

FIG. 1 schematically illustrates an example of a system 100 in accordance with the present invention for using network connected light sources to communicate across a distance with other associated light sources. A first light source 110 and a second light source 120 are illustrated in the example of FIG. 1, but additional light sources beyond the pair illustrated in the example of FIG. 1 may be used in accordance with the present invention. For example, a system in accordance with the present invention, such as system 100, may provide a plurality of associated pairs of light sources and/or other associated groupings involving more than two light sources.

In the example of FIG. 1, a first light source 110 uses a wireless connection 140 to access a network router 150. For example, a network router 150 may comprise a wireless router and wireless connection 140 may comprise communications exchanged between the first light source 110 and the network router 150 using a wireless protocol. Network router 150 may connect 160, via any desired media and protocol, to a network 170, such as the Internet. Similarly, second light source 120 may be wirelessly connected 142 to a network router 152 connected 162 to a network 172 such as the Internet. The network 170 accessed by the first light source 110 and the network 172 accessed by the second light source 120 may comprise different networks or the same network. A first network 170 and a second network 172 are illustrated as distinct networks in the example of FIG. 1 for exemplary purposes only. Further, one or both of first network 170 and second network 172 may each comprise multiple networks or subnetworks. The example of FIG. 1 omits elements of system 100 that facilitate accessing and operating networks 170, 172, such as routers, switches, Domain Name Servers, and the like for the sake of clarity.

Still referring to the example of FIG. 1, a server 190 may connect 180 to first network 170 and may connect 182 to second network 172. Each of first connection 180 and second connection 182 may comprise packets exchanged with server 190 over one or more network. Server 190 may exchange packet-based communications with first light source 110 and/or second light source 120. In some examples, an address (such as an IP address or a domain name that can be mapped by DNS) for server 190 may be provided to lighting devices (such as first light source 110 and second light source 120, as well as any additional light sources not illustrated in the example of FIG. 1) to permit a light source to access server 190 for purposes of initial setup and subsequent communication. Such a server 190 address may be permanent or temporary. An address may also be associated with each light source in FIG. 1 for use in routing communications to the light source, but those addresses may be assigned by an entity such as an internet service provider (and may therefore change from time to time) and are often blocked by a firewall, so accordingly the light source may provide its address to the server 190 for use in exchanging communications. To facilitate the unique identification of individual light sources, each light source in a system in accordance with the present invention may receive a unique identifier, such as an alphanumeric code, that may be used to identify an individual light source independent of any address associated with that light source. Such a unique code may be provided during the manufacturing of a given light source.

Server 190 may be used to facilitate communication between the first light source 110 and the second light source 120 (and/or additional light sources not illustrated in the example of FIG. 1). For example, if first light source 110 is appropriately engaged by a user physically interacting with first light source 110, first light source 110 may transmit information to server 190. Based upon the information received by server 190 from first light source 110, server 190 may transmit information to second light source 120. The information ultimately transmitted to second light source 120 at the initiation of first light source 110 may activate or in some other way alter the operation of second light source 120. In a similar fashion, a user engaging second light source 120 may cause the transmission of a message to server 190 that causes server 190 to propagate a message to first light source 110 to causes the first light source 110 to activate or otherwise alter its operation.

In some examples of conventional network configurations, a firewall provided by a router or a switch may be present between light sources (such as light source 110, 120) and a server (such as server 190), and in such an example the IP address of the firewall may be provided to the server(s) for use to route communications to a light source. Such a firewall will also often prevent the server(s) from initiating a connection with a light source. In such examples, a light source may initially open a communication channel with the server(s), with messages sent from the light source to the server(s) at periods (such as every sixty seconds) to keep that communication channel open, thereby permitting the server(s) to use the open channel to send communications to the light source. If the connection between a light source and a server is broken, the light source may seek to re-initiate the connection. If the attempted re-initiation of a connection with a server fails, a light source may provide an appropriate error message for a user.

Systems and methods in accordance with the present invention enable a remote light source to activate or alter the operation of a local light source, and likewise permit a local light source to activate or alter the operation of a remote light source. Whether a given light source is "local" or "remote" is a matter of whether a given user is able to physically interact with the light source and perceive light emitted by the light source; a single light source may be both a "local" light source and a "remote" light source at the same time.

The activation or alteration of a light source by a remote light source may take a variety of forms. For example, a remote light source may simply cause a local light source to activate and emit light. In other examples, a particular color of light may be emitted by a local light source in response to a remote light source, potentially with different colors of light associated with different remote light sources. The alteration of the behavior of a local light source based upon inputs provided by a user of a remote light source may comprise any manipulation of the light emitted by the local light source. For example, the light intensity, color, flashing, duration, or other property may be controlled based upon an input received at a remote light source.

While the light sources 110, 120 depicted in the example of FIG. 1 need not be limited to a first light source 110 and a second light source 120, they likewise need not be limited to a particular type of light source. For example, light emitting diodes (LEDs), incandescent bulbs, compact fluorescent bulbs, fluorescent bulbs, or other light generating technologies may be used in some or all of the light sources provided in a system such as exemplary system 100 depicted above in FIG. 1. A single light source may comprise one or more individual elements that emit light. One example of an appropriate light source providing multiple individual LEDs that emit light is illustrated in the example of FIGS. 2A-2C and described further below, but the present invention is not limited to this example.

Figure 2A:
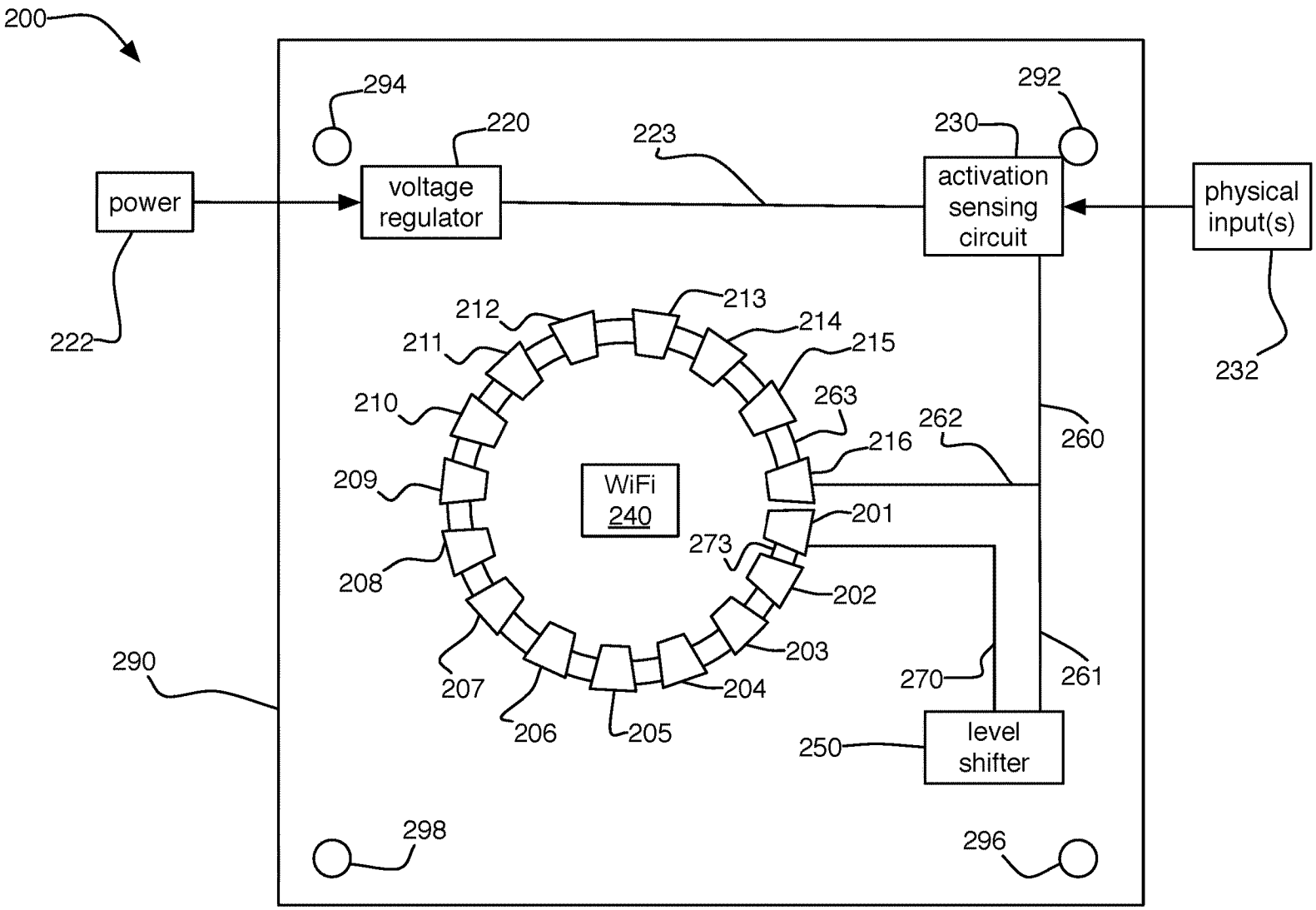
FIGS. 2A-2C schematically illustrate an example of a lighting system in accordance with the present invention.
Figure 2C:
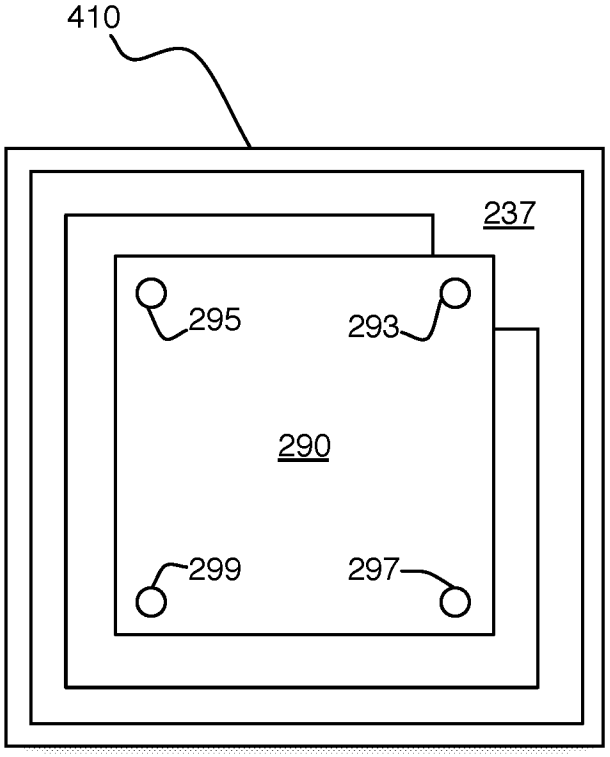
Figure 2B:
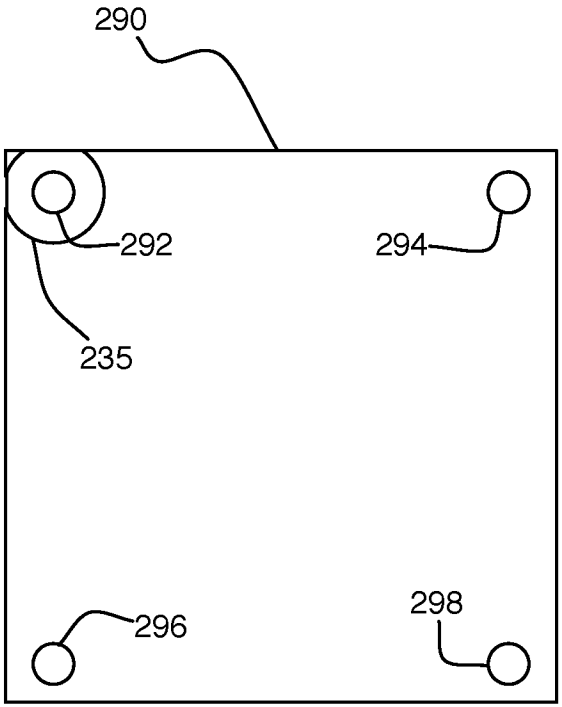

Referring now to FIG. 2A, a lighting device 200 may use a plurality of electrical components provided on one or more printed circuit board 290. Printed circuit board 290 may contain a plurality of circuit elements and microcontrollers to permit a lighting device 200 to operate as described herein. Printed circuit board 290 may have a size and shape that permits it to be mounted on a base 410 and/or contained within a shade assembly or other housing when the lighting device 200 is assembled for use. A plurality of holes 292, 294, 296, 298 may be provided to receive screws 293, 295, 297, 299 to retain printed circuit board 290 to base 410 and, if a capacitive sensing system as described in examples herein is used, to establish reliable electrical connections between elements of circuit board 290 and input regions on lighting device 200. Input regions may comprise a conducting portion of a shade panel, a conductive portion of a frame that retains one or more shade panel, a conductive portion of a base, or any other input mechanism electrically connected to printed circuit board 290. In some examples of systems and methods in accordance with the present invention, a printed circuit board 290 may be replaced, in whole or in part, but electrical connections between the electrical components described in conjunction with the example of FIG. 2.

Printed circuit board 290 may provide a plurality of elements that emit light, such as a plurality of LEDs, to produce light in response to an input received from a user locally and/or in input received from a remote user at a remote light source associated with the local light source 200. In the example of FIG. 2A, sixteen light emitting diodes 201-216 may be arranged in a circular fashion, but more or fewer LEDs in different geometric arrangements, or even light emitting elements other than LEDs, may be used with a light source in accordance with the present invention. The LEDs 201-216 may be capable of emitting light at a variety of wavelengths and/or a variety of intensities. The wavelength of emitted light, the intensity of emitted light, and which of the plurality of diodes is activated to emit light at a given wavelength or intensity may be controlled using circuitry and/or software provided elsewhere on the lighting source 200. One example of LEDs that may be used in accordance with the present invention are WS2812 RGB LEDs connected in a daisy chain and (optionally) individually addressable by a microcontroller. A lighting device having individually addressable LEDs may adjust the on/off status, color, and/or intensity of single LEDs (or groups of LEDs, if desired) simultaneously.

A wireless connection module 240 may be provided as part of light source 200. A wireless connection module 240 may comprise, for example, one or more antenna and the appropriate hardware to operate in accordance with a wireless communication protocol, such as one of the 802.11 protocols (referred to commonly asked "Wi-Fi"), a Bluetooth protocol, a Zigbee protocol, or other communication protocols. A wide variety of modules that may be used as a wireless connection module 240 are commercially available, one example of which is an ESP8266-12e FCC-certified COTS WiFi module available from Espressif Systems (Shanghai) Pte. Ltd.

Light source 200 may receive power 222 from a power source such as an electrical outlet and/or a battery. Power 222 may be regulated using a voltage regulator 220 to provide power at a voltage acceptable and appropriate to the other electric components of light source 200. The type and voltage rating a voltage regulator 220 used in accordance with the present invention, as well as whether a voltage regulator is used at all, may vary based upon the electrical components used in lighting device 200. One example of a voltage regulator 220 that may be used in systems and methods in accordance with the present invention is a regulator that receives a 5V input and provides a 3.3V regulated output.

An activation sensing circuit 230 may receive physical inputs 232 from a local user. In an example further described herein, capacitance sensing is used to detect a touch from a user, but other types of inputs, such as buttons, levers, dials, keyboards, motion detectors, sound responsive sensors, voice recognition systems, load sensors, light detection, or other input devices may provide physical inputs from a local user that are received by activation sensing circuitry 230. In the example of a lighting device 200 operated using touch inputs detected by activation sensing circuit 230, an activation sensing circuit 230 may comprise a sensor such as an AT42QT1010 sensor available from Atmel Corporation, although many different sensors may be used in the example of a lighting device operated by receiving user inputs based upon capacitive sensing. If capacitive sensing is used in a lighting device 200 in accordance with the present invention, a reliable electrical contact must be made between the activation sensing circuit(s) 230 and the touch surface(s) of lighting device 200 that are to receive those inputs.

A level shifter 250 may control the response of light source 200, particularly the activation status, wavelength, and/or intensity of LEDs 201-216 activated by lighting device 200. Level shifter 250 may receive inputs from activation sensing circuit 232 and/or inputs from wireless communication module 240 corresponding to inputs received at a remote lighting device (not illustrated in FIG. 2). Level shifter 250 may additionally relay locally received inputs from a user to the wireless communication module 240 for transmission to a remote lighting device associated with the lighting device 200.

Level shifter 250 may further control the activation of one or more LED 201-216 even in absence of an input by adjusting the operation of one or more LED based upon the time lapsed since one or more prior input. For example, an input received may initially activate the LEDs 201-216 at a given intensity, which may then gradually reduce the intensity over a period of time, such as five minutes, thirty minutes, an hour, or multiple hours. Further, the operation and response of LEDs 201-216 may vary based upon parameters such as the time of day, the last input received, the type of input received, etc. Level shifter 250 may comprise various types of digital and/or analogue circuits, such as a microcontroller. One example of a microcontroller that may be used with systems and methods in accordance with the present invention is a BSS138 N-Channel Logic Level Enhancement Mode Field Effect Transistor available from Fairchild Semiconductor, although other microprocessors may be used without departing from the scope of the present invention.

While the example of FIG. 2A illustrates a light source 200 having a discrete activation sensing circuit 230, wireless communication module 240, and level shifter 250, the functionality of these components may be combined into fewer or distributed into more components than are illustrated in the example of FIG. 2A. Further, components providing for functionality in addition to or instead of the functions performed by the components described with regard to the example of FIG. 2A may be incorporated into a light source in accordance with the present invention. For example, a light source that receives only touch inputs from a local user and does not distinguish between different types of touches may provide elegant simplicity of use, but light sources in accordance with the present invention may receive a variety of different inputs that result in different responses by the illumination elements of the light source.

The components of a light source 200 provided on a printed circuit board 290 depicted in the example of FIG. 2A may be affixed to a platform, either directly or indirectly, and that platform may be used as the base of a light source in accordance with the present invention. A shade may be provided for mounting to the platform to provide an aesthetically appealing appearance and, optionally, a touch input mechanism for using the light source. An example of the mounting of the exemplary printed circuit board 290 to an exemplary base 410 is shown in conjunction with FIGS. 2B and 2C.

FIG. 2B illustrates the bottom of printed circuit board 290, flipped to show holes 292, 294, 296, and 298. A sensing pad 235 electrically connected to activation sensing circuit 230 extends along the bottom of printed circuit board 290 around hole 292. Sensing pad 235 permits a reliable electrical connection to be made between activation sensing circuit 230 and a capacitive sensing input region contacted by a user.

FIG. 2C illustrates the printed circuit board 290 affixed to a base 410 using a plurality of screws 293, 295, 297, 299 that pass through holes 292, 294, 296, 298. Printed circuit board 290 may be affixed to base 410 oriented as depicted in FIG. 2A, such that sensing pad 235 depicted in FIG. 2B contacts a conductor 237 provided in base 410. Conductor 237 may electrically connect sensing pad 235 to a capacitance sensing input zone provided elsewhere on lighting device 200, to permit signals created by a user touching an input zone to be transmitted to activation sensing circuit 230. Conductor 237 may comprise a conducting foil retained in base 410 such that screws 293, 295, 297, 299 maintain sensing pad 235 in contact with conductor 237. A conducting foil may be constructed of aluminum, copper, gold, or any other conducting material. As depicted in the example of FIG. 2C, the conductor 237 may extend within the base 410 around the perimeter of base 410 in order to contact conducting surfaces provided in a shade to serve as one or more capacitive sensing input zone. Conductor 237 may overlay a compressible material that permits sensing pad 235 and/or conducting surfaces provided in a shade to be pressed against conductor to establish a reliable electrical connection. In some examples in accordance with the present invention, twosided foam tape may be used both to retain conductor within base 410 and to provide a compressible underlayment beneath conductor.

Figure 3:
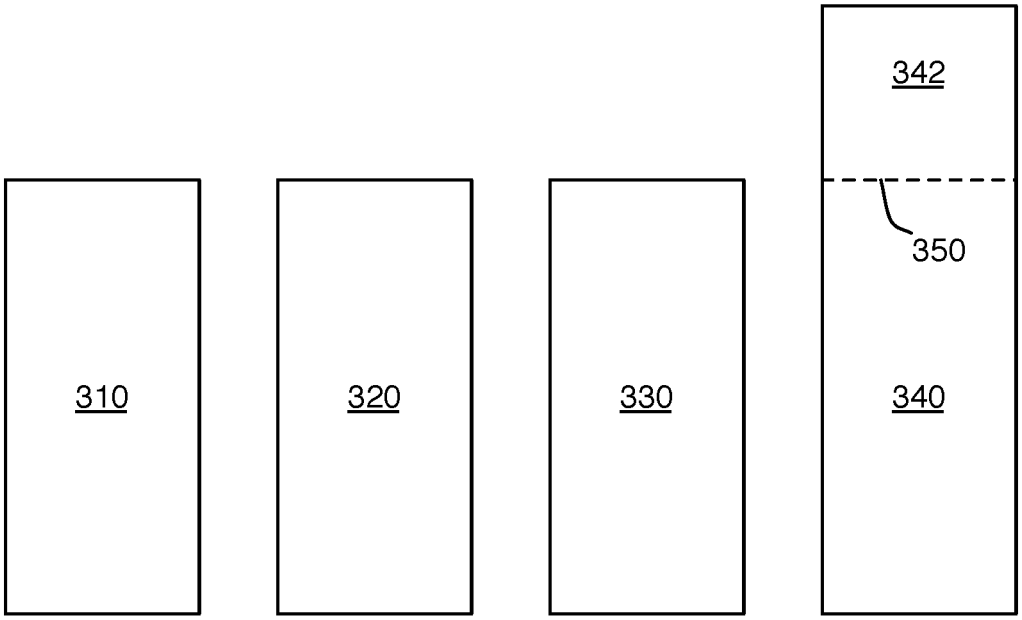
FIG. 3 illustrates an example of panels that may be assembled to form the shade of a lighting system in accordance with the present invention.
Figure 4:
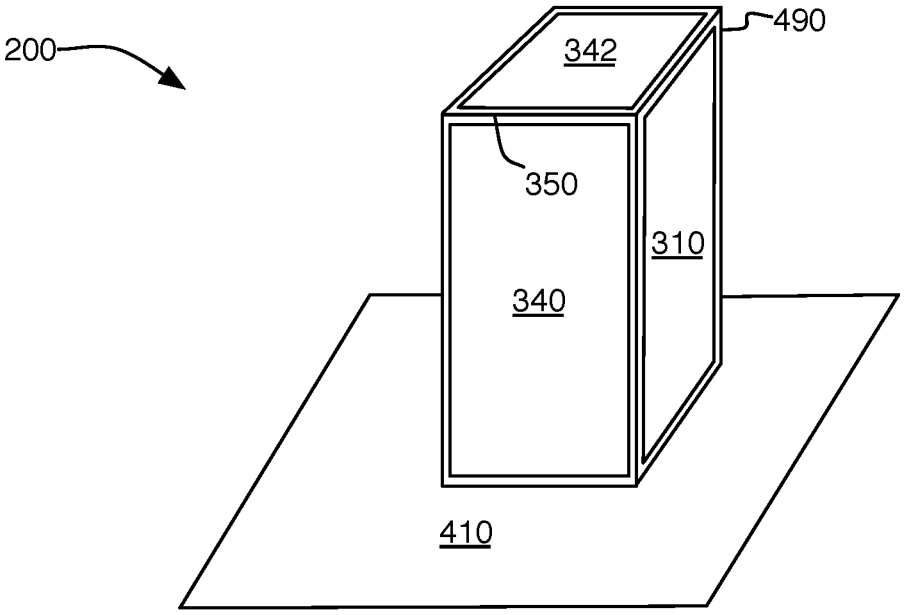
FIG. 4 illustrates a perspective view of an example of a lighting system in accordance with the present invention assembled by affixing the exemplary panels of FIG. 3 to a base.

Referring now to FIG. 3 and FIG. 4, one example of a light source 200 assembled from multiple panels that form a shade to enclose the electrical components (such as the example illustrated in FIG. 2A) and to provide an aesthetically pleasing appearance is illustrated. While any number of panels may be used to form a shade in accordance with the present invention, the example of FIGS. 3 and 4 illustrate a shade with four sides and a top formed from a first panel 310, a second panel 320, a third panel 330, and a fourth panel 340 retained to base 410 with a frame 490. In the example of FIGS. 3 and 4, capacitance sensing permits an input to be received by light source 400 when a panel 310, 320, 330, 340 is touched by a user. In further examples, capacitance sensing may permit an input to be received by light source 400 through frame 490 and/or base 410. As shown in the example of FIG. 3, a first panel 310, a second panel, 320, and a third panel 330 may have substantially identical sizes and shapes, while a fourth panel 340 may have a top portion 342 that may be folded 350 to enclose the top of light source to create a cuboid-shaped shade (i.e., a shade resembling a box). In some examples, however, top portion 342 may be omitted or provided as a separate panel. In further examples, the entire shade, of whatever shape, may be folded from a single panel or formed from multiple panels in a different construction than depicted in the present example. The various control components and LEDs described in the example of FIG. 2A may be affixed to a base 410 and contained within the resulting shade. As explained above with regard to the example of FIG. 2C, an electrical connection may be established between a capacitive sensing input zone provided on the panels 310, 320, 330, 340 and the enclosed activation sensing circuit 230.

Figure 5:
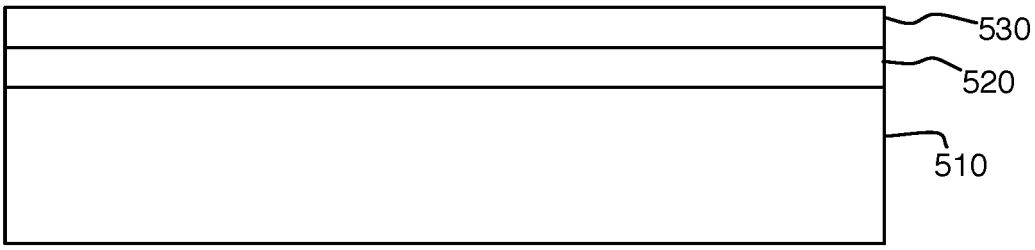
FIG. 5 schematically illustrates an example of a cross section of a panel that may be used in lighting system in accordance with the present invention.

Referring now to FIG. 5, an example of a cross section of panel that may provide capacitance sensing for use as both part of a shade and an input mechanism for a light source in accordance with the present invention is illustrated. By using a base sheet formed of a material having a desired resilience, rigidity, and translucence (which may vary depending upon the intended location of use or preferences of a use of a light source) and using a layer of conducting material, such as conductive ink or paint, all or part of a shade may be receive touch inputs from a user that cause a lighting device in accordance with the present invention to alter its illumination and/or to transmit a control message to alter the illumination of a remote lighting device.

A base sheet 510 may be comprised of polycarbonate, glass, thin paper, or any other material having physical properties suited to a use environment and a user's preferences. A first layer of ink 520 may be applied to sheet 510. The first layer of ink 520 may be nonconductive ink. The first layer of ink 520 may be black or any other color desired for aesthetic purposes. In some examples, the first nonconductive ink layer 520 may be omitted. A conductive layer of ink 530 may be applied on top of the first nonconductive layer of ink 520 or, if the first ink layer 520 was omitted, directly onto sheet 510. First layer of ink 520 and a second layer of conductive ink 530 may be applied in patterns that provide a pleasing aesthetic effect and/or may be selected to possess colors to provide a pleasing aesthetic effect. The sheet 510 may be cut into individual panels (such as panels 310, 320, 330, 340) before or after the layer(s) of ink have been applied. Conductive ink may be applied to one or more edge of panels 310, 320, 330, 340 that will contact conductor 237 as described in conjunction with FIG. 2C.

Figure 6:
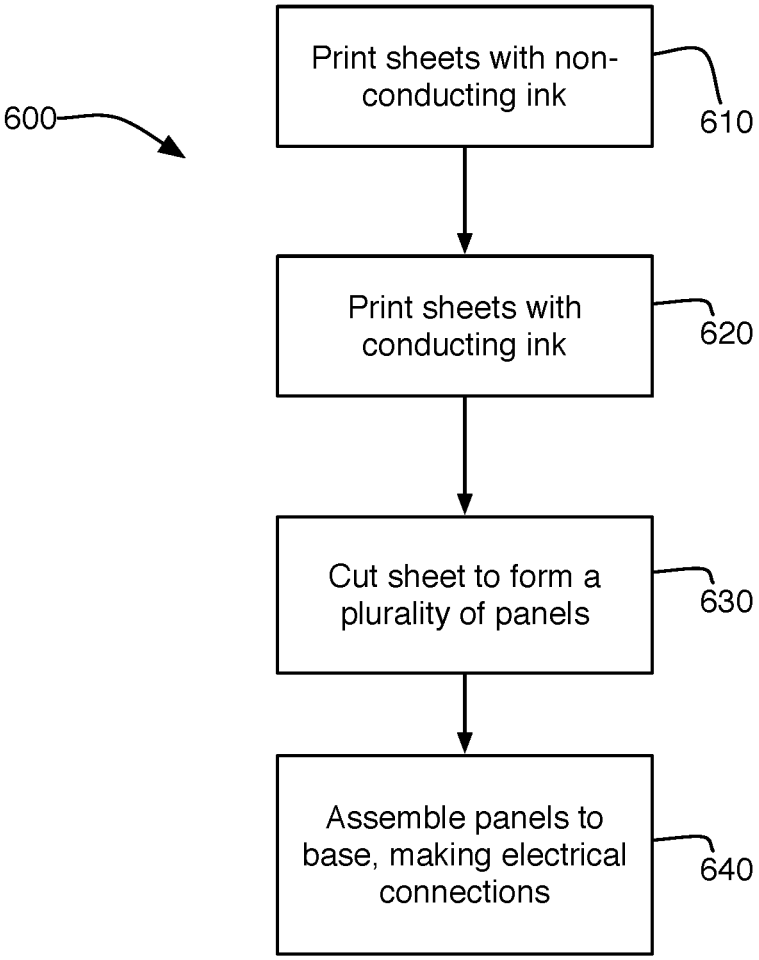
FIG. 6 illustrates an example of a method for creating a lighting system in accordance with the present invention.

Referring now to FIG. 6, an example method 600 for forming a plurality of sheets into a shade for use with a light source, such as a light source 400 illustrated in the example of FIG. 4, is illustrated. Method 600 may begin with step 610, in which a sheet may be printed with a nonconducting ink having a color and/or pattern that is aesthetically pleasing. In step 620, the sheet may be printed with a conducting ink to provide capacitive sensing capabilities to a shade constructed from the sheet. In step 630, the sheet may be cut to form a plurality of panels. The number of panels to be cut in step 630 may be four, as depicted in the example of FIGS. 3 and 4, but may be more or fewer. One or more of the panels cut in step 630 may include a top portion for the shade to be formed or may serve as a top portion for the shade to be formed. In step 630, the sheets may be assembled to a base (such as base 410 depicted in the example of FIG. 4). Step 630 may be performed before or after step 610 and/or step 620. The panels may be assembled with the conducting ink oriented outwards, toward a user, or may be assembled with the conducting ink oriented inward, or away from a user. Capacitive sensing detects proximity of a touch to a conductor and, in many examples, the thickness of a panel and the material from which a panel is constructed does not inhibit detection of a touch (or a near-touch) on the un-inked surface of a panel. Step 640 may establish appropriate electrical connections between the conducting ink applied in step 630 and activation sensing circuitry, such as depicted as activation sensing circuitry 230 in the example of FIG. 2A. Step 640 may involve providing conducting ink at an edge of the panels and installing the panels to a base (such as base 410) to contact a conductor (such as conductor 237 as shown in FIG. 2C). In this fashion, when a user touches a sheet, the capacitance change resulting from that contact may be detected by the activation sensing circuitry. The activation sensing circuitry may use the analog capacitance change over time as a trigger to detect an input, i.e. to activate if the capacitance changes more than a given amount within a certain period of time. In this fashion, the activation sensing circuitry may alter the behavior of the light emitted by the lighting device 400 if a touch is detected.

Figure 7:
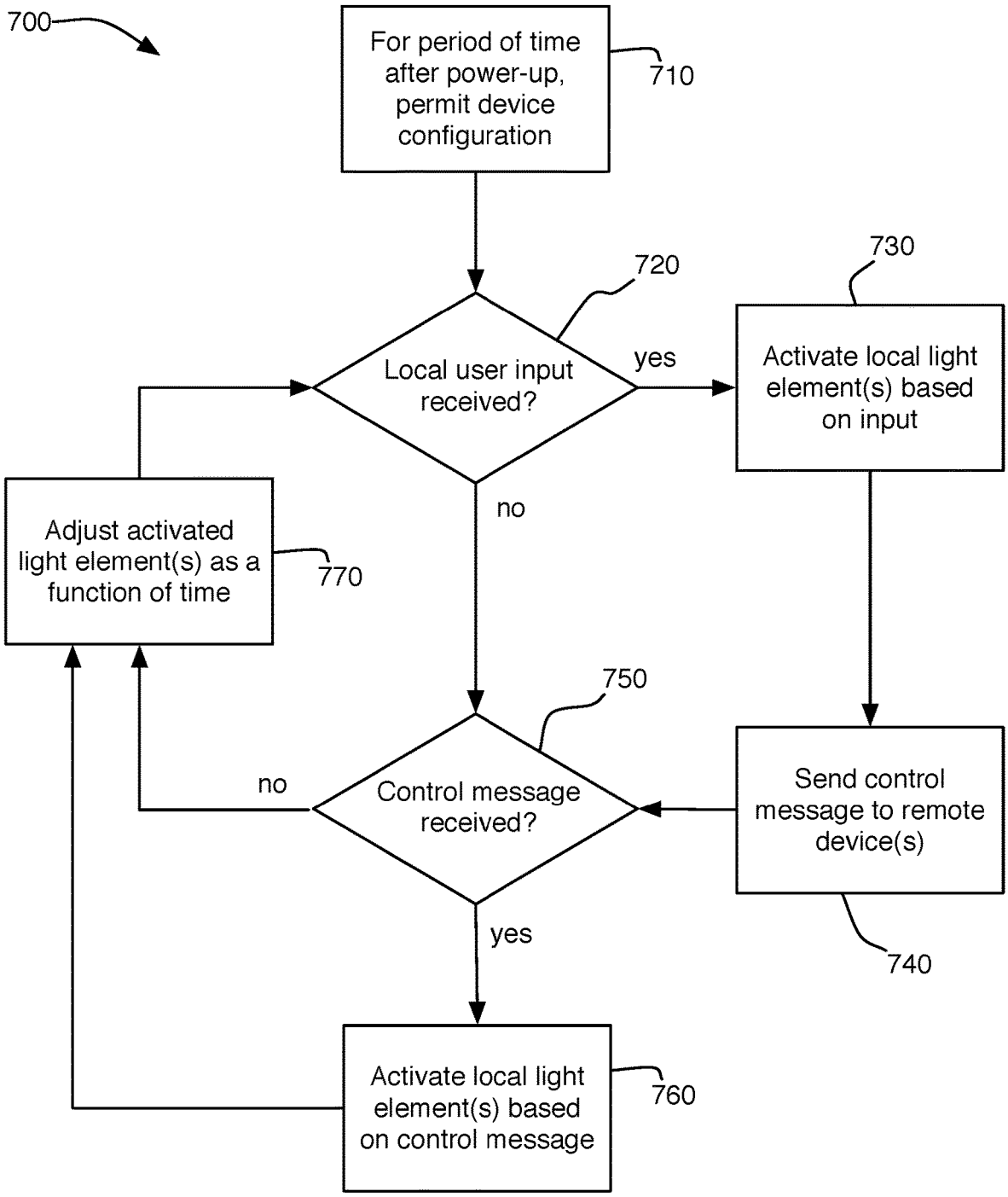
FIG. 7 illustrates an example of a method of operating communicative lighting systems in accordance with the present invention.

Referring now to FIG. 7, an example of the operation of one of two or more associated lighting devices is illustrated. Method 700 may begin with the power on step 710 which may permit the configuration of the lighting device for a period of time after the lighting device is connected to a power source. For example, step 710 may permit the wireless network connectivity of the lighting device to be configured, to associate the lighting device with another lighting device, to create a password for future modifications, to determine the responses made by the light source to various local or remote inputs, to set time parameters for the modification of illumination as a function of time, to set certain times during which the response of the light source to messages from associated remote light sources will be reduced or eliminated (for example, to prevent an activation from waking a sleeping user), and the like. Step 710 may also access a server to check for firmware or software updates.

After the power up and/or set up of step 710 has concluded, method 700 may proceed to step 720 to determine whether a local user input has been received. A local user input may be received, for example, using a capacitance sensing system such as described above. If the conclusion of step 720 is that a local user input has been received, method 700 may proceed to step 730 and step 740. If the conclusion of step 720 is that no local user input is received, method 700 may proceed to step 750.

If a local user input is received in step 720, in step 730 the local light elements (such as LEDs contained in the lighting device) may be activated based on that input. The activation performed in step 730 may be based upon a configuration made in step 710. For example, which light element is activated and how it is activated may be defined in configuration step 710. Activating one or more light element in step 730 may switch one or more light element between an on/off status, may modify the color or intensity emitted by one or more light element, may alter (or initiate or stop) the pattern of flashes of one or more light element, or otherwise modify the behavior of one or more light element. The activation of one or more local light element in step 730 may vary based upon the time of day, the status of the lighting device or an individual light element (such as what color of light is being emitted in response to a prior input), etc. Such variations may be designated in configuration step 710 in some examples. In some examples, a lighting device or an individual light element may cycle through a number of predetermined levels (which may be predetermined for all lighting devices of a particular type in accordance with the present invention or predetermined at configuration step 710), with a shift made from one level to another made for each input received, whether the input is received locally or remotely.

If step 720 determines that a local user input has been received, method 700 may also proceed to step 740 to send a control message to one or more associated remote lighting device. The type of control message sent in step 740 may be based upon a configuration set in step 710. Step 740 may use an intermediate server or servers to transmit such a control message. The control message(s) transmitted in step 740 may alter the behavior of the remote lighting device as described herein in conjunction with method 700 or in accordance with another method.

Whether method 700 proceeds directly from step 720 to step 750 or whether method 700 detects a local input in step 720 and proceeds through steps 730 and steps 740 before arriving at step 750, method 700 may arrive at step 750 to determine whether a control message has been received from an associated remote lighting device. A control message received in step 750 may ultimately originate from an associated remote lighting device, but may be transmitted via one or more server over a network such as the Internet. If the conclusion of step 750 is that no control message has been received, method 700 may proceed to step 770 (described further below) and return to step 720 to determine whether a local user input has been received. If the conclusion of step 750 is that a control message has been received, method 700 may proceed to step 760.

In step 760, one or more local light element may be activated in response to the received control message. As with step 730, in step 760 the activation of one or more light element in response to a control message may be based, in whole or in part, on a configuration made in step 710. Activating one or more light element in step 760 may switch one or more light element between an on/off status, may modify the color or intensity emitted by one or more light element, may alter (or initiate or stop) the pattern of flashes of one or more light element, or otherwise modify the behavior of one or more light element. The activation of one or more local light element in step 760 may vary based upon the time of day, the status of the lighting device or an individual light element (such as what color of light is being emitted in response to a prior input), etc. Such variations may be designated in configuration step 710 in some examples. In some examples, a lighting device or an individual light element may cycle through a number of predetermined levels (which may be predetermined for all lighting devices of a particular type in accordance with the present invention or predetermined at configuration step 710), with a shift made from one level to another made for each input received, whether the input is received locally (as in step 730) or remotely (as in step 760).

In step 770, if one or more light element has been activated either by a local input or a control message received from a remote lighting device, the activation level of the light element may be adjusted as a function of time. For example, step 770 may decrease the intensity of the light emitted by a light source in increments until the intensity is eventually reduced to zero. Step 770 may thereafter return to step 720 and, ultimately, step 750 to receive local inputs and control messages, respectively. Method 700 may continue until the light source is disconnected from power source.

In some further examples in accordance with the present invention, a local input detection (such as by step 720 of method 700) and/or the receipt of a control message (such as by step 750 of method 700) may return method 700 to configuration step 710 if the input/control message meets certain parameters. For example, a touch-input in a certain pattern or a control message containing a particular command may return a lighting device to a mode that permits a user to configure the device.

Systems and methods in accordance with the present invention, such as method 700 and lighting device 200, may permit individuals to use two or more associated lighting devices to communicate over great distances. For example, a grandmother may touch her lighting device to activate her grandson's lighting device. As a result of his lighting device activating, the grandson would then know that his grandmother was thinking of him, even if the two of them and their respective lighting devices are separated by many miles, or even continents or oceans.

While systems and methods in accordance with the present invention may provide output devices such as displays (or may display information using software operating on a computing device such as a smartphone or a PC), in many examples, such as some of those described herein, a lighting device in accordance with the present invention primarily or solely outputs information using the one or more light elements incorporated into the lighting device. Similarly, a lighting device in accordance with the present invention may provide various input devices, but as described in some examples herein may primarily or solely use a touch-based input system. Accordingly, a lighting source in accordance with the present invention may optionally provide information about its status using one or more incorporated lighting element. While the present invention is not limited to any particular schema for indicating the status of a lighting device, some examples of a schema for indicating the status of a lighting device in accordance with the present invention are described below.

For example, a lighting device in accordance with the present invention may indicate status and errors with pulses. For example, when first plugged in, a lighting device may slowly pulse green to indicate that it is searching for a known Wi-Fi connection. If no known Wi-Fi connection is found, the lighting device may change to more rapidly pulsing orange. If the lighting device establishes a Wi-Fi connection, the light emitted may turn red to indicate that the device is searching for a software or firmware update from a server (sometimes referred to as a broker) accessed over one or more network. A green light may indicate that a "handshake" between the lighting device and the broker is in progress. After accessing an update or determining that no update is needed, the lighting device may produce a mix of colors as a "celebratory rainbow" to indicate to the user that power-up has been successful. Other visual indicators that may be provided to a user are: a fast blue pulse to indicate that a Wi-Fi connection has been made but that no Internet connection was established (such as may occur if a router is working but a modem is not, for example); a fast red pulse to indicate that a certificate failure with the MQTT broker (described further below), which may indicate that a hacking event has occurred; and a slow purpose pulse to indicate that the lighting device is in configuration mode.

Lighting devices in accordance with the present invention may communicate over networks and/or data connections using various protocols for exchanging information (such as control messages or configuration information), and/or to establish the identity of a lighting device, and/or for security purposes. While not limited to any particular protocol or combination of protocols, examples of the implementation of some protocols for these purposes are described below.

Lighting devices in accordance with the present invention may communicate through Wi-Fi using the SSL/TLS 1.2 protocol. Lighting devices may share one or more private key hardcoded in software or hardware included on the device or stored in EEPROM or other memory to permit the key(s) to be updated. Each lighting device may have a unique identification. One way to provide a unique identification for each lighting device is to use a unique identifier included in a wireless communication module used to enable a Wi-Fi or other type of wireless communication.

Upon start-up, a lighting device may read one or more stored Wi-Fi name and password stored on EEPROM within the device. As the device attempts to connect to the Wi-Fi, it may provide a slow green pulse; if connection fails, the device may provide a fast orange pulse. After a failure to connection, a device may once again attempt to connect to the Wi-Fi after two minutes have elapsed. After successfully connecting to Wi-Fi and the Internet, a lighting device may contact a server (an IP address or domain name for the server may optionally be hardcoded in software, firmware, or hardware included in the device, or may be stored in EEPROM or other memory) using the device's private key to check for firmware or software updates. A server may optionally be dedicated solely to distributing firmware/software updates to lighting devices. To check for an update, a lighting device may provide the server: the unique identifier of the lighting device, the firmware or software version of the lighting device, and an API key for security. The server may respond with: an indication that no update is available, an indication of an API key failure, or by sending an available update to the lighting device. If an update is available, the server may also send the size of the update and an md5 checksum to confirm the integrity of the transmitted update. If the update is successfully received (for example, if the security checks match), the lighting device may reboot and a bootloader may copy the contents of the new update over the prior firmware (or software) to restart the start-up process.

After a successful connection to the internet and an update check, a lighting device may attempt to connect to an MQTT broker. A greenish-blue light may from the lighting device may signify the process of contacting the MQTT broker. To connect to the MQTT broker, the lighting device may use TLS/SSL and the hardcoded private key contained on the device. The lighting device may also be provided with a client ID prefix that must be correct to successfully connect to the MQTT broker in order to provide an additional layer of security. Upon successful connection, the lighting device may subscribe to one or more channel to provide a way to send messages uniquely to the lighting device, as well as to all lighting devices in accordance with the present invention.

A lighting device in accordance with the present invention may also read its EEPROM to determine what group message channels to subscribe to with the MQTT broker. For example, a device may subscribe to as many as a maximum number of groups, such as sixteen groups. Such groups may define the other lighting devices in accordance with the present invention that are associated with an individual lighting device. For example, if lighting devices A, B, and C subscribe with the MQTT broker, a first group may include A and B while a second group may include B and C, with no group containing A and C (although such a group could be formed, it need not be formed). The individual lighting device may publish to associated devices that the lighting device is online, as well as the group(s) the device is subscribed to and the firmware version the device is running. A lighting device may also send a message to indicate that it is being powered off in order to indicate that the device is offline until it re-establishes a connection. Messages to and/or from a lighting device may be in the JSON format. A lighting device may parse received messages for an identification corresponding to itself and disregard any such message, as the subscribed channel may relay messages that the lighting device sent to other associated lighting devices.

While lighting devices in accordance with the present invention may have a built-in real time clock, or RTC, they may have one or more mode that limits or eliminates the reaction of the lighting device to a control message and/or a local input. For example, a lighting device used by a child may be placed in a mode that prevents activation of a light element(s) during specified times to avoid disturbing the child's sleep. In order for a lighting device to know the current time without a built-in RTC, a proxy may append a time onto every message sent through the server. When initially configured, the lighting device may store in EEPROM the difference between the time indicated by the server and the local time. The stored difference may be used to calculate the local time when a message is received, thereby permitting the lighting device to respond appropriately to a received message. In some examples, a lighting device may be entirely prevented from illuminating during a timeframe, while in others the lighting device may illuminate at a low intensity during those time periods.

The initial configuration, or subsequent re-configuration, of a lighting device in accordance with the present invention may occur within a predetermined amount of time after the device is connected to a power source. The predetermined amount of time after power-up during which a lighting device may be configured can be two minutes, but other amounts of time can be used in accordance with the present invention. During configuration, a lighting device may transmit a "Soft AP" or "Access Point" signal, which is an SSID that permits any Wi-Fi enabled device to be connected to the lighting device. A user may connect to the lighting device using a computing device, such as a PC, smartphone, or tablet computer, to configure the lighting device. In order to access the lighting device for configuration, the user may be required to enter information provided to a purchaser of the device, such as a unique name or other identifier and a password. Some or all of such information may be provided in product packaging and/or upon the lighting device itself. The configuration process may permit a user to provide a Wi-Fi network name and password (if required), to associate the lighting device with one or more other lighting device, to define the alteration of illumination to be made in response to various inputs, to define one or more time during which no or a limited response will be made to messages from associated lighting device, to specify the local time (and thereby obtain the difference between the time of the server and the local time), and/or other parameters. As part of configuration, as well as ongoing operation of a lighting device in accordance with the present invention, the lighting device may use a Wi-Fi network and an Internet connection to access one or more server. The server(s) accessed may be reached using an IP address hardcoded into the lighting device or otherwise provided.

The adjustment of light output by a lighting device as a function of time, one example of which is described in conjunction with step 770 of method 700 in the example of FIG. 7, may occur in a variety of fashions. In one example, the brightness and color of light emitted may be adjusted every three milliseconds after an input (whether a local input or a remote input), with a total time to deactivating the light entirely (absent another input) within a specified period of time, such as one half hour, one and a half hours, eight hours, twenty-four hours, etc. The frequency of such updates and/or the total time to deactivate the light may vary from this example and/or may be configurable by a user.

While the present invention has been described in examples herein, these examples are not limiting. The present invention is not limited to any particular size, shape, material, hardware type or arrangement, software type or arrangement, network architecture, input type, light element type, or power source.

The invention claimed is:

1. A communicative lighting system comprising:

a first light source connected to a first network, the first light source having at least one input mechanism, at least one light output mechanism, and a permanently assigned first identifier retained in a non-transitory computer-readable memory within the first light source, the non-transitory computer-readable memory within the first light source further providing computer readable instructions to be executed by a computer processor within the first light source;

a second light source connected to a second network, the second light source having at least one input mechanism, at least one light output mechanism, and a permanently assigned second identifier retained in a non-transitory computer-readable memory within the second light source, the non-transitory computer-readable memory within the second light source further providing computer readable instructions to be executed by a computer processor within the second light source; and a server connected to at least one network accessible to both the first light source via the first network and the second light source via the second network, the server receiving messages from at least the first light source and the second light source to associate the first light source and the second light source with one another, such that when an input is made using the at least one input mechanism at the first light source the operation of the at least one light output mechanism of the second light source alters and such that when an input is made using the at least one input mechanism at the second light source the operation of the at least one light output mechanism of the first light source alters; and wherein the computer readable instructions retained in the non-transitory computer-readable memories of the first light source and the second light source cause the computer processors of the first light source and the second light source to contact the server to register a network address of each of the first light source and the second light source, and wherein the receipt of an input at the input mechanism of the first light source causes a message to be transmitted from the first light source to the server and then from the server to the second light source to alter the operation of the at least one light output mechanism of the second light source, and wherein the receipt of an input at the input mechanism of the second light source causes a message to be transmitted from the second light source to the server and then from the server to the first light source to alter the operation of the at least one light output mechanism of the first light source.

2. The communicative lighting system of claim 1, wherein the at least one input mechanism of the first light source and the at least one input mechanism of the second light source comprise a touch-sensitive surface on a shade covering the at least one light output mechanism.

3. The communicative lighting system of claim 2, wherein the touch-sensitive surface comprises a conductive ink applied to a shade panel.

4. The communicative lighting system of claim 2, wherein the touch-sensitive surface comprises a conducting frame that retains a shade panel.

5. The communicative lighting system of claim 2, wherein the touch-sensitive surface comprises a base section.

6. The communicative lighting system of claim 2, wherein the at least one light output mechanism of the first light source and the second light source comprise a plurality of light emitting diodes.

7. The communicative lighting system of claim 6, wherein altering the operation of the plurality of light emitting diodes comprises a change in color of the light emitted by the plurality of light emitting diodes.

8. The communicative lighting system of claim 7, wherein the computer readable instructions retained in the non-transitory computer-readable memories of the first light source and the second light source further cause the computer processors of the first light source and the second light source to dim the light output from the plurality of light emitting diodes over time if no further inputs are received by the first light source and the second light source.

9. The communicative lighting system of claim 7, wherein the computer readable instructions retained in the non-transitory computer-readable memories of the first light source and the second light source further cause the first light source and the second light source to be accessible over a data connection by a computing device to configure the operation of the light source.

10. The communicative lighting system of claim 9, wherein configuring the operation of the first light source using the computing device to access the light source over the data connection comprises entering the unique identifier of the second light source to pair the first light source and the second light source in at the server.

11. A communicative lighting system comprising:

a plurality of light sources, each of the plurality of light sources comprising:

a plurality of light emitting diodes contained within a shade, an input mechanism, a wireless network connection providing a data connection to at least one wireless network, at least one computer processor that receives inputs from the input mechanism, controls the output of the light emitting diodes, and sends and receives communications over the wireless network connection, and a non-transitory computer-readable memory containing a permanently assigned unique identifier corresponding to that light source and computer readable instructions retained in a non-transitory form to be executed by a computer processor within the first light source to perform at least part of a method of interaction between at least two of the plurality of light sources; and a server accessible by at least some of the plurality of light sources via at least one network, the server having at least one computer processor operating based upon computer-readable instructions retained in a non-transitory form to cause the server to perform at least part of the method of interaction between at least two of the plurality of light sources; and wherein the method of interaction between at least two of the plurality of light sources comprises:

in response to an input received at an input device of a first light source, altering the output of the plurality of light emitting diodes of the first light source;

in response to an input received at an input device of a first light source, transmitting a message to at least a second light source; and at the second light source, in response to the message from the first light source, altering the output of the plurality of light emitting diodes of the second light source.

12. The communicative lighting system of claim 11, wherein the method further comprises configuring at least a pair of the plurality of light sources using a computing device connected via the wireless network connection of at least one of the pair of the plurality of light sources to enter the unique identifier of at least one other of the plurality of light sources to be associated with the at least one of the pair of light sources at the server.

13. The communicative lighting system of claim 12, wherein the input mechanism of at least some of the plurality of light sources comprises a conductive ink applied to at least a portion of the shade of the light source.

14. The communicative lighting system of claim 12, wherein the input mechanism of at least some of the plurality of light sources comprises a conductive frame retaining at least a panel of the shade of the light source.

15. The communicative lighting system of claim 12, wherein altering the output of the plurality of light emitting diodes comprises altering the color of light emitted.

16. The communicative lighting system of claim 15, wherein the method of interaction between at least two of the plurality of light sources further comprises transmitting messages between light sources via the server.

17. The communicative lighting system of claim 15, wherein the method of interaction between at least two of the plurality of light sources further comprises dimming the light emitted from the light emitting diodes of the light source as a function of time if the light source does not receive an input from the input device or a message from another light source.

* * * * *